US010092084B1

(12) United States Patent
Celebrero

(10) Patent No.: US 10,092,084 B1
(45) Date of Patent: Oct. 9, 2018

(54) FOOD AND BEVERAGE TRAY HEAD GEAR

(71) Applicant: David Conlan Celebrero, Saint Anthony, MN (US)

(72) Inventor: David Conlan Celebrero, Saint Anthony, MN (US)

( * ) Notice: Subject to any disclaimer, the term of this patent is extended or adjusted under 35 U.S.C. 154(b) by 0 days.

(21) Appl. No.: 15/693,576

(22) Filed: Sep. 1, 2017

(51) Int. Cl.
*A45F 5/00* (2006.01)
*A47G 23/06* (2006.01)
*A42B 1/00* (2006.01)
*A42B 1/02* (2006.01)

(52) U.S. Cl.
CPC ..... *A45F 5/00* (2013.01); *A42B 1/006* (2013.01); *A42B 1/02* (2013.01); *A47G 23/0641* (2013.01)

(58) Field of Classification Search
CPC ..... A45C 2200/20
USPC ..... 224/148.4
See application file for complete search history.

(56) References Cited

U.S. PATENT DOCUMENTS 1,418,198 A * 5/1922 Neppell ..... A42B 1/201 2/183
2,209,609 A * 7/1940 Odom ..... A42B 1/24 2/175.3
2,375,643 A * 5/1945 Germanotta ..... A45D 44/04 108/43
D263,915 S * 4/1982 Kohan ..... D2/887
D294,670 S * 3/1988 Kurtz ..... D27/133
4,739,905 A * 4/1988 Nelson ..... A42B 3/048 2/422
4,837,865 A * 6/1989 Roth ..... A42B 1/208 2/12
5,094,343 A * 3/1992 Brown ..... A42B 1/006 206/216
5,708,983 A * 1/1998 Cross ..... A42B 1/004 2/171
5,727,250 A * 3/1998 Black ..... A42B 3/227 2/10
5,857,219 A * 1/1999 Edmark ..... A42B 1/201 2/175.2
6,012,174 A * 1/2000 Rech ..... A42B 1/004 2/195.1
D424,281 S * 5/2000 Jebber ..... D2/869
6,256,794 B1 * 7/2001 Erickson ..... A42B 1/201 2/171.03
6,374,419 B1 * 4/2002 Pietsch ..... A42B 1/004 2/209.13
D513,821 S * 1/2006 Kenig ..... 426/104
D555,996 S * 11/2007 Romero ..... D8/38
D560,044 S * 1/2008 Roes ..... D30/121
D643,185 S * 8/2011 King ..... D2/869
8,402,564 B2 * 3/2013 Duwyn-Zylstra ..... A42B 1/22 2/175.1
2013/0048038 A1 * 2/2013 Herrera ..... A45B 11/00 135/31
2013/0205475 A1 * 8/2013 Jones ..... A42B 1/201 2/209.13

* cited by examiner

*Primary Examiner* — Brian D Nash
(74) *Attorney, Agent, or Firm* — Dave Alan Lingbeck

(57) ABSTRACT

A food and beverage tray head gear for conveniently carrying food and beverages hands free. The food and beverage tray head gear includes a hat having a crown and a brim disposed about the crown. The hat has a bottom with a head-receiving cavity disposed through the bottom and into the crown. The present invention also includes a tray removably supported upon the hat for carrying food and beverages.

4 Claims, 3 Drawing Sheets

FOOD AND BEVERAGE TRAY HEAD GEAR

BACKGROUND OF THE INVENTION

Field of the Invention

The present invention relates to head gears and more particularly pertains to a new food and beverage tray head gear for conveniently carrying food and beverages hands free.

Description of the Prior Art

The use of head gears is known in the prior art. More specifically, head gears heretofore devised and utilized are known to consist basically of familiar, expected and obvious structural configurations, notwithstanding the myriad of designs encompassed by the crowded prior art which have been developed for the fulfillment of countless objectives and requirements.

The prior art includes a foam hat depicting a race car has a smooth outer surface providing a more realistic depiction of the car by promoting the formation of a void free skin on the foam. The hat may include a pocket for the user's head as well as flanking pockets for beverage cans or the like so as to provide additional utility as a carrying tray. Another prior art includes a combination beverage tray and sun visor comprised of a beverage tray having, raised side walls and including a pre-formed perforation along a portion of the junction of the base of said tray and the side walls wherein the base may be separated from the sidewalls thereby forming an opening which allows the beverage tray to be converted into a sun visor and worn upon one's head. While these devices fulfill their respective, particular objectives and requirements, the aforementioned patents do not disclose a new food and beverage tray head gear.

SUMMARY OF THE INVENTION

The general purpose of the present invention, which will be described subsequently in greater detail, is to provide a new food and beverage tray head gear which has many of the advantages of the head gears mentioned heretofore and many novel features that result in a new food and beverage tray head gear which is not anticipated, rendered obvious, suggested, or even implied by any of the prior art head gears, either alone or in any combination thereof. The present invention includes a hat having a crown and a brim disposed about the crown. The hat has a bottom with a head-receiving cavity disposed through the bottom and into the crown. The present invention also includes a tray removably supported upon the hat for carrying food and beverages. None of the prior art includes the combination of the elements of the present invention.

There has thus been outlined, rather broadly, the more important features of the food and beverage tray head gear in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new food and beverage tray head gear which has many of the advantages of the head gears mentioned heretofore and many novel features that result in a new food and beverage tray head gear which is not anticipated, rendered obvious, suggested, or even implied by any of the prior art head gears, either alone or in any combination thereof.

Still another object of the present invention is to provide a new food and beverage tray head gear for conveniently carrying food and beverages hands free upon a user's head.

Still yet another object of the present invention is to provide a new food and beverage tray head gear that avoids party food and beverages from being knocked out of a person's hand by someone bumping into them.

Even still another object of the present invention is to provide a new food and beverage tray head gear that is a novelty item.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
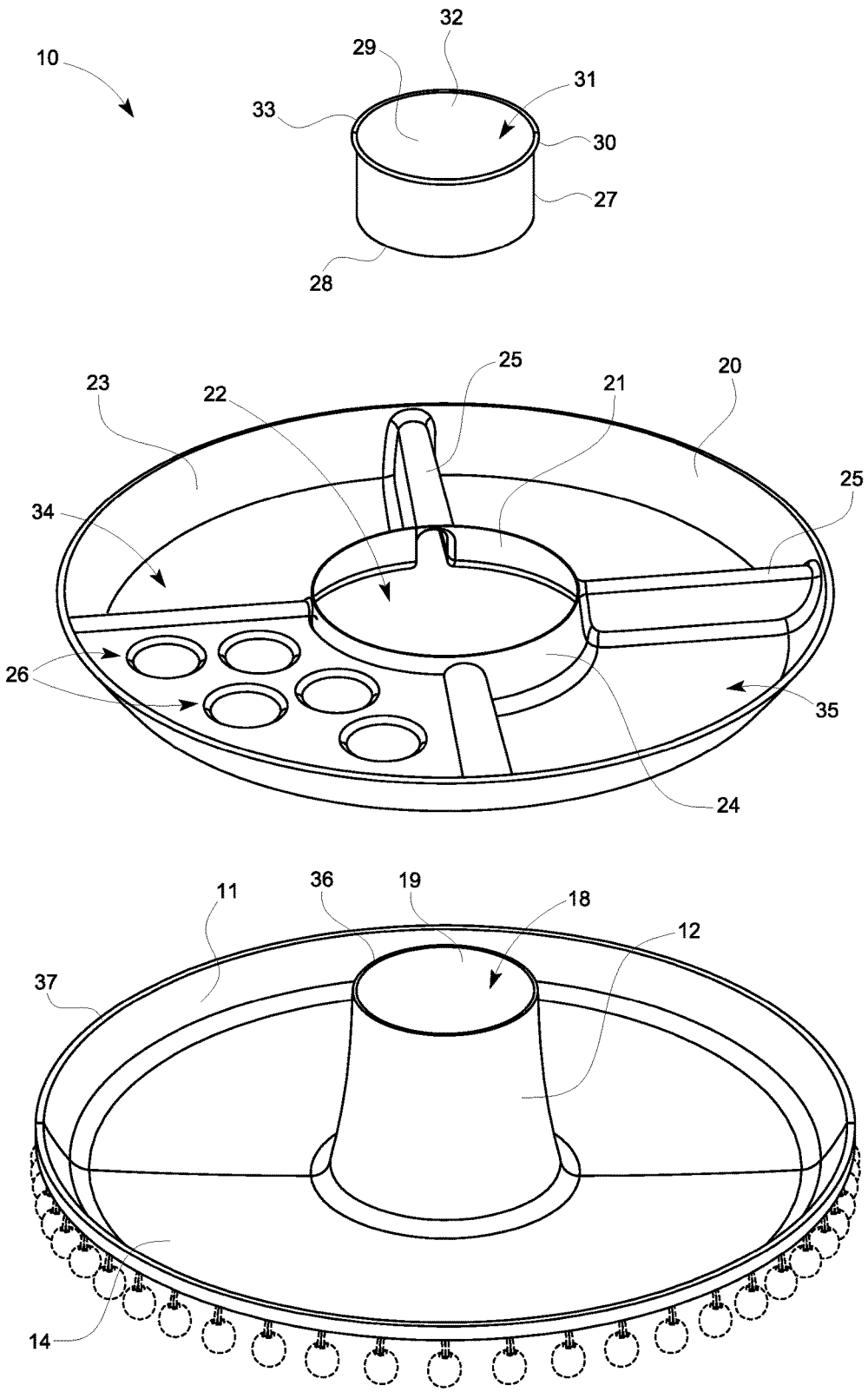
FIG. 1 is an exploded top perspective view of a new food and beverage tray head gear according to the present invention.
Figure 2:
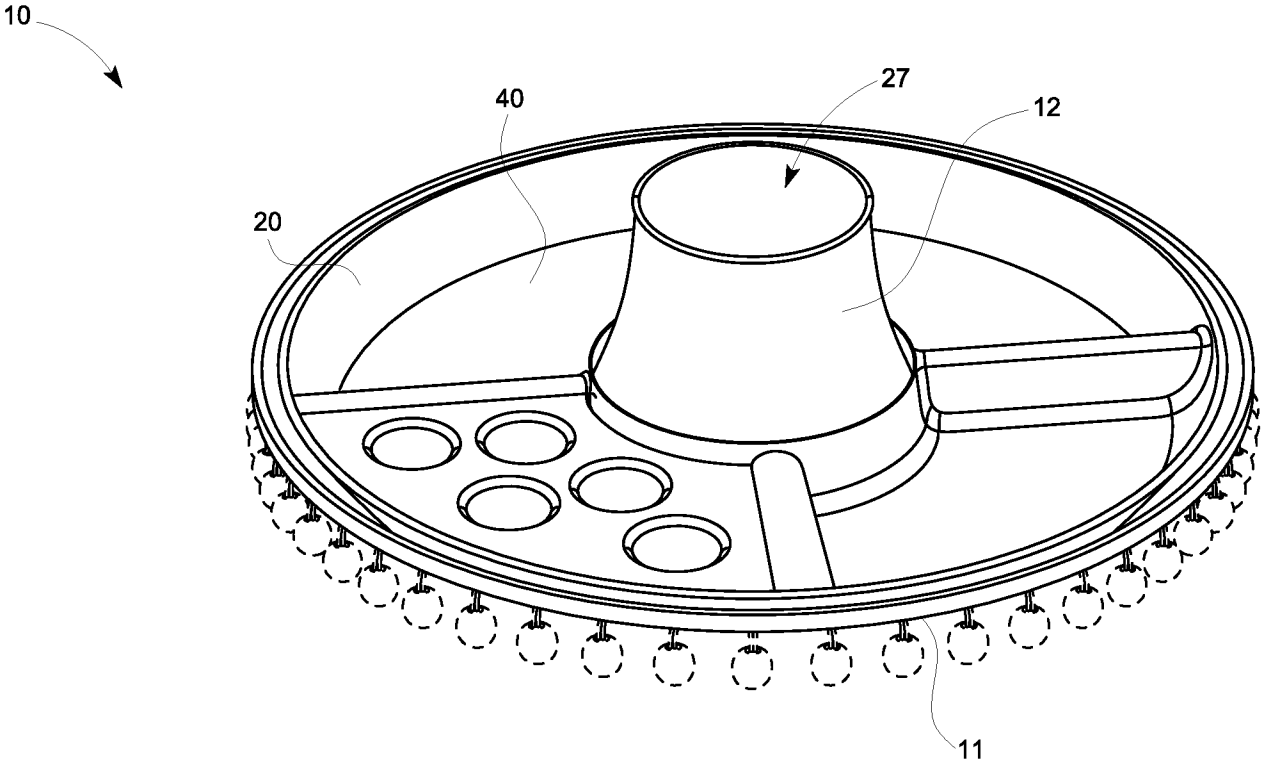
FIG. 2 is a top perspective view of the present invention.
Figure 3:
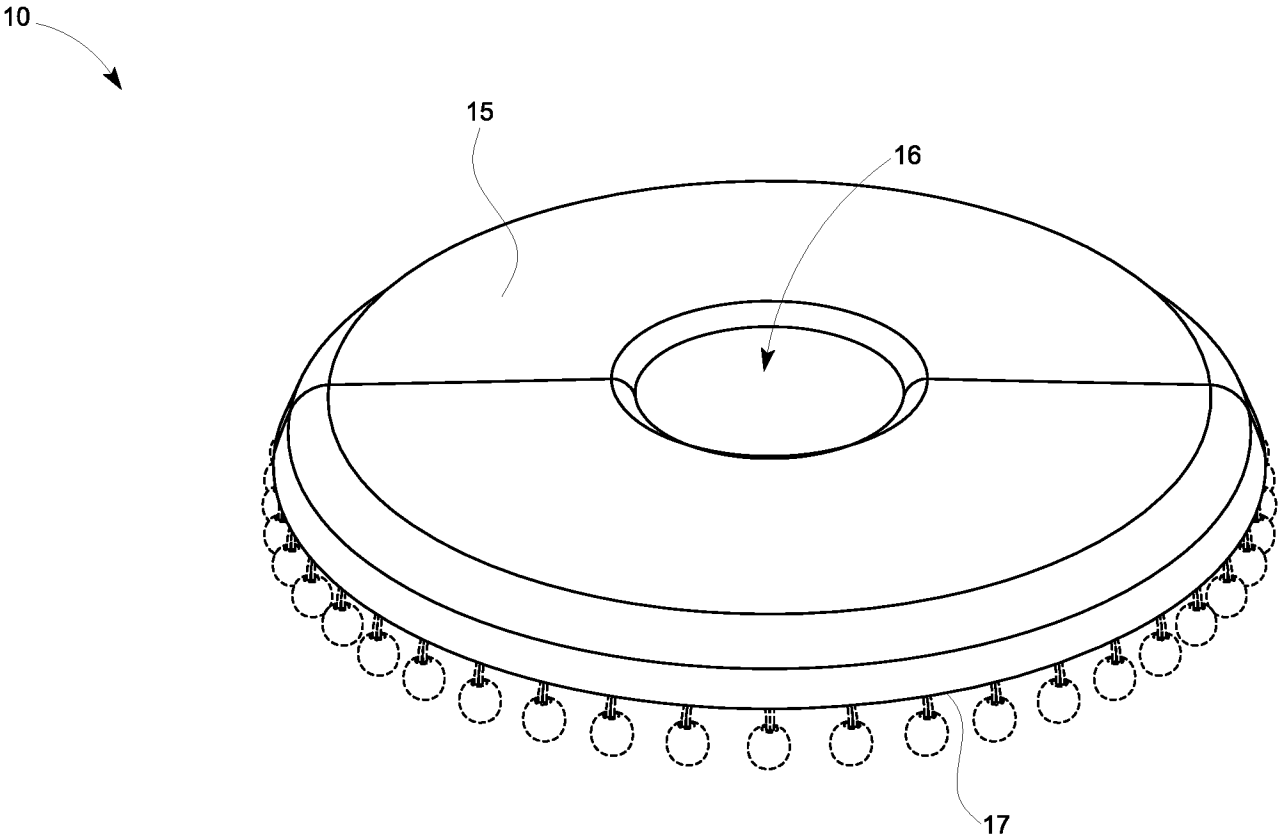
FIG. 3 is a bottom perspective view of the present invention.

With reference now to the drawings, and in particular to FIGS. 1 through 3 thereof, a new food and beverage tray head gear embodying the principles and concepts of the present invention and generally designated by the reference numeral 10 will be described.

As best illustrated in FIGS. 1 through 3, the food and beverage tray head gear 10 generally comprises a hat 11 made of fabric and having a crown 12 and a brim 14 disposed 360 degrees about the crown 12. The hat 11 has a bottom 15 with a head-receiving cavity 16 disposed through the bottom 15 and into the crown 12. A tray 20 is removably and conventionally supported upon the hat 11 for carrying food and beverages. The brim 14 has a width and extends outwardly from and around the crown 12. The crown 12 extends upwardly from the brim 14.

The tray 20 is circular, has a bottom wall 40 and has a center 21 with an opening 22 disposed through the center 21. The crown 12 is removably disposed through the opening 22 with the tray 20 resting, upon the brim 14. The tray 20 has an outer rim 23, and also has an inner rim 24 forming the opening 22 through the tray 20. The outer and inner rims 23, 24 are turned upwardly. The tray 20 also has raised portions 25 spaced apart and disposed upon the bottom wall 40 and integrally interconnecting the inner and outer rims 23, 24 to form compartments 34, 35 therebetween upon the bottom wall 40 to support food and beverages. One of the compartments 35 has recessed portions 26 spaced apart and sized to support beverage containers including shot glasses.

The crown 12 has a top 13 with a hole 18 disposed therethrough. A container 27 having, bottom and side walls 28, 29 and also a top 30 with a cavity 31 disposed therein for supporting food. The container 27 is removably seated in the hole 18 of the crown 12. The side wall 29 has a top end 32 with a rim 33 integrally disposed along the top end 32 and bulging outwardly from the side wall 29. The crown 12 has an edge 36 forming the hole 18. The rim 33 is removably rested upon the edge 36 to support the container 27 in the hole 18 upon the hat 11. The brim 14 has an outer rim 37 which is turned upwardly.

In use, the tray 20 is placed about the crown 12 upon the brim 14 of the hat 11, and the container 27 is disposed in the hole 18 of the crown 12 and various types of foods are placed in the compartments 35 and beverages in appropriate sized glasses are placed in the recessed portions 26. Food is also placed in the container 27. The server then places the hat 11 upon his/her head and serves the food and beverages.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the food and beverage tray head gear. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A food and beverage tray head gear comprising:

a hat made of fabric and having a crown and a brim disposed about the crown, wherein the hat has a bottom with a head-receiving cavity disposed through the bottom and into the crown, wherein the crown has a top with a hole disposed therethrough; and a tray removably supported upon the hat for carrying food and beverages.

2. The food and beverage tray head gear as described in claim 1 further includes a container having bottom and side walls and also a top with a cavity disposed therein for supporting food; wherein the container is removably seated in the hole of the crown.

3. The food and beverage tray head gear as described in claim 2, wherein the side wall has a top end with a rim disposed along the top end and bulging outwardly from the side wall.

4. The food and beverage tray head gear as described in claim 3, wherein the crown has an edge forming the hole; wherein the rim is removably rested upon the edge to support the container in the hole upon the hat.

* * * * *